US009565918B2

(12) United States Patent
Bouix et al.

(10) Patent No.: US 9,565,918 B2
(45) **Date of Patent: *Feb. 14, 2017**

(54) HEATING SYSTEM FOR SINGLE-USE PACKETTES

(71) Applicant: ELC Management LLC, Melville, NY (US)

(72) Inventors: Herve F. Bouix, New York, NY (US); Christophe Jacob, Franqueville-Saint-Pierre (FR)

(73) Assignee: ELC MANAGEMENT LLC, Melville, NY (US)

( * ) Notice: Subject to any disclaimer, the term of this patent is extended or adjusted under 35 U.S.C. 154(b) by 327 days.

This patent is subject to a terminal disclaimer.

(21) Appl. No.: 14/309,341

(22) Filed: Jun. 19, 2014

(65) Prior Publication Data

US 2015/0366320 A1 Dec. 24, 2015

(51) Int. Cl.
*H05B 3/34* (2006.01)
*A45D 40/00* (2006.01)

(52) U.S. Cl.
CPC ..... *A45D 40/0087* (2013.01); *H05B 3/34* (2013.01); *A45D 2200/155* (2013.01); *H05B 2203/003* (2013.01); *H05B 2203/013* (2013.01); *H05B 2203/016* (2013.01); *H05B 2203/02* (2013.01)

(58) Field of Classification Search
None
See application file for complete search history.

(56) References Cited

U.S. PATENT DOCUMENTS 2,699,779 A * 1/1955 Lustig ..... A61F 7/02 206/210
3,573,430 A * 4/1971 Eisler ..... B65D 81/3476 219/385
3,829,654 A * 8/1974 Eisler ..... A47J 36/022 219/386
3,879,171 A * 4/1975 Tulis ..... A61L 2/20 219/212
4,087,675 A * 5/1978 Sansonetti ..... H05B 3/342 2/158
4,163,896 A * 8/1979 McAvinn ..... A61F 15/00 219/386
4,437,567 A * 3/1984 Jeng ..... B65D 81/24 206/210
4,761,541 A * 8/1988 Batliwalla ..... H01C 7/027 219/528
4,777,351 A * 10/1988 Batliwalla ..... H01C 7/027 219/528
4,912,306 A * 3/1990 Grise ..... H05B 3/34 219/543
5,486,680 A * 1/1996 Lieberman ..... H01M 2/1066 2/905
6,222,160 B1 * 4/2001 Remke ..... A45C 11/20 219/387

(Continued)

*Primary Examiner* — Joseph M Pelham
(74) *Attorney, Agent, or Firm* — Peter Giancana

(57) ABSTRACT

A heating system comprising a pouch, into which one or more single-use packettes are placed for heating. In preferred embodiments, the pouch comprises printed heating elements, printed circuit elements and a means of connecting to a power source. Power may be supplied through a USB-type connector or a handheld power supply that is custom designed to work with the heating pouch.

5 Claims, 7 Drawing Sheets

(56) References Cited

U.S. PATENT DOCUMENTS

| | | | | |
|---|---|---|---|---|
| 6,599,657 | B1 * | 7/2003 | Pollett | H01M 2/1005 29/623.1 |
| 6,726,386 | B1 * | 4/2004 | Gruenbacher | A01N 25/34 15/104.94 |
| 7,021,848 | B1 * | 4/2006 | Gruenbacher | A61M 35/003 126/263.08 |
| 7,022,950 | B2 * | 4/2006 | Haas | A41D 13/0051 219/212 |
| 7,108,440 | B1 * | 9/2006 | Gruenbacher | A47L 13/19 15/227 |
| 7,182,739 | B2 * | 2/2007 | Kopanic | A61F 7/03 601/15 |
| 7,255,506 | B2 * | 8/2007 | Gruenbacher | A01N 25/34 15/227 |
| 8,336,738 | B2 * | 12/2012 | Bouix | A45D 34/00 219/628 |
| 9,173,471 | B2 * | 11/2015 | Inoue | A45D 34/046 |
| 9,320,337 | B2 * | 4/2016 | Bouix | A45D 40/18 |
| 2002/0014485 | A1 * | 2/2002 | Fernando | B01F 1/00 219/543 |
| 2003/0102296 | A1 * | 6/2003 | Nelson | B60N 2/5685 219/217 |
| 2005/0224388 | A1 * | 10/2005 | Saric | F24J 1/00 206/554 |
| 2008/0097356 | A1 * | 4/2008 | Donovan | A61K 8/0208 604/291 |
| 2008/0261441 | A1 * | 10/2008 | Shih | B65H 75/4431 439/501 |
| 2009/0032516 | A1 * | 2/2009 | Reasor | B65D 81/3897 219/201 |
| 2009/0114633 | A1 * | 5/2009 | Naylor | H05B 1/0236 219/213 |
| 2012/0138595 | A1 * | 6/2012 | Watakabe | H05B 3/34 219/528 |

* cited by examiner

HEATING SYSTEM FOR SINGLE-USE PACKETTES

FIELD OF THE INVENTION

The invention is in the field of cosmetic and personal care packettes, such as those freely distributed in magazines and other promotional programs. The invention is also directed to heated cosmetic products.

BACKGROUND

Packettes for distributing product are well known in the cosmetic and personal care fields. A basic packette that is suitable for distribution in magazines and elsewhere is made conventional paper webs that are coated to prevent oil absorption. Alternatively, plastic laminates and foil laminates are also used. A typical packette may comprise a sheet having first and second panels which are able to fold against each other, and bond along the perimeter of the panels. Bonding may be achieved by a continuous line of adhesive or welding, for example. A reservoir for product is defined between the bonded panels. Each panel may be on the order of 100μ to 250μ thick. A means for opening the packette to retrieve product from the reservoir is generally provided. For example, a pull tab or tear strip may be located along a weaker section of the sheet. In general, packettes are relatively flat. Many packettes are basically rectangular or square, and measure 25 mm-150 mm on a side, while larger and smaller packettes, and differently shaped packettes are also known. The two opposing panels of the packette may be decorated by any suitable means known in the packaging arts, such as ink printing. Sometimes, the packette materials are treated to impart an improved quality to finished packette. For example, foil packettes may be treated to make the foil less permeable to air and water. Plastic packettes may be treated to prevent yellowing of the packette material. Many types of treatment are known for application to either the inside or the outside of the packette.

In the cosmetics and personal care field, some packettes are used for distributing on the order of 1 g to 5 g of product, or enough product for exactly one application (i.e. a single-use packette). These single-use packettes are not usually provided with means to reseal the packette after it has been opened by a user. Single-use packettes are suitable to give away as free product samples, or they may be sold in bulk quantities.

Packettes that are suitable for holding more than 1 g to 5 g of product are also used in the cosmetics and personal care markets. These packettes may be designed to supply enough product for two, three or more complete makeup or personal care treatments, rather than just one. In this case, the packettes may be resealable, with a zip lock or threaded closure mechanism, for example. These larger packettes may contain 10 g or more of product, and are intended for individual retail sale, or for sale in bulk quantities.

Packettes are suitable for holding a wide range of products, including creams, lotions, gels, liquids, powders and pastes; skin treatment products, color makeup products and fragrance products. Sheet-type articles are also suitable for distribution in packettes. Examples of such products include moist towelettes for cleaning the hands and face, and sheet-type mask products for treating the skin. There is usually only one sheet-type article in a single packette, which may. therefore, be considered a single-use packette. Packettes that incorporate a wand type applicator are also known. The wand extends into the packette and is used to retrieve product from the reservoir. If the packette is intended for more than one application, then the applicator may be part of a closure system that seals the packette between uses.

Nowadays, personal care companies seek to attract consumers by incorporating a source of heat into the cosmetic or personal care experience. Up to now, the cost and complexity of doing so has prevented companies from supplying means to heat packettes that are intended to be given away as a free sample. However, when a free packette sample is intended to drive the sale of a commercial size heated product, then it would be advantageous if the product supplied by the packette were also heated. The present invention addresses this need.

OBJECTIVES

A main objective is to provide a simple means for heating the product inside a cosmetic or personal care single-use packette.

Another objective is to economically provide a single-use package of heat activated cosmetic or personal care product, immediately prior to use of the product.

Another objective is to provide a single-use packette that can be heated anywhere, without connecting to a power grid or electric mains.

Another objective is to transform the use of a conventional packette into a multi-sensory experience.

SUMMARY

The present invention is a system for heating packettes. The system comprises a pouch into which one or more single-use packettes are placed for heating. In some preferred embodiments, the pouch comprises printed heating elements and printed circuit elements. The pouch is reusable, and may be sealable to keep the heat in. The system further comprises means for connecting the pouch to a power source. The system is designed may be used away from the home, and without connecting to a power grid. The pouch circuit may comprise various electronic hardware and software elements, such as: a timer, a digital memory structure, a digital operating system, and programming code.

DETAILED DESCRIPTION

By "single-use" packette, we mean a packette without a means to reseal the packette after it has been opened by a user. Preferred single-use packettes hold 10 g or less of product; more preferably 5 g or less of product; most preferably 2 g or less of product. Hereinafter, "packette" means "single-use packette", unless otherwise stated.

By "comprise", we mean that a group of elements is not limited to those explicitly recited, but may or may not include additional elements.

The Heating Pouch

Figure 1:
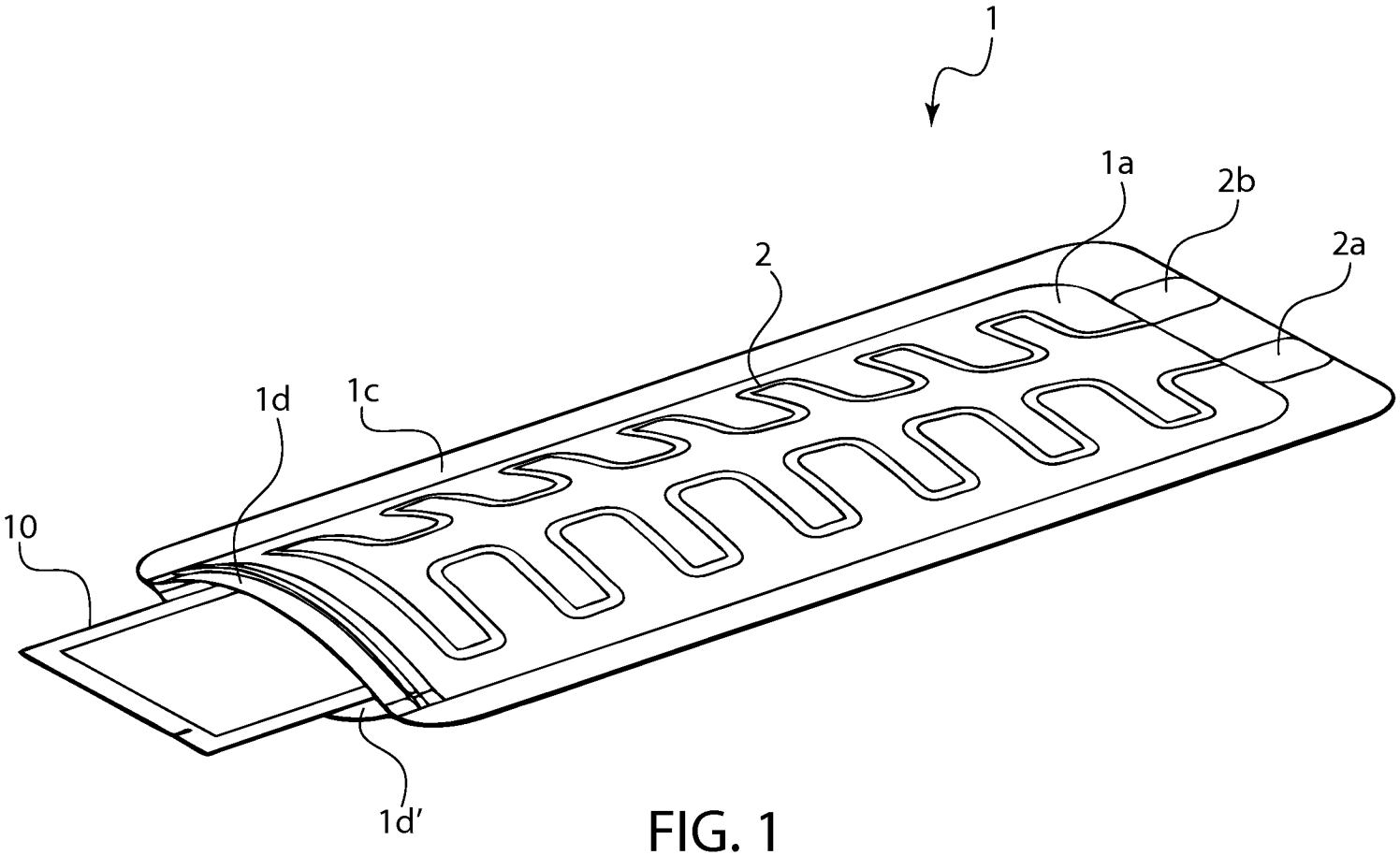
FIG. 1 is perspective view of a packette being received into one embodiment of a heating pouch of the present invention.
Figure 2:
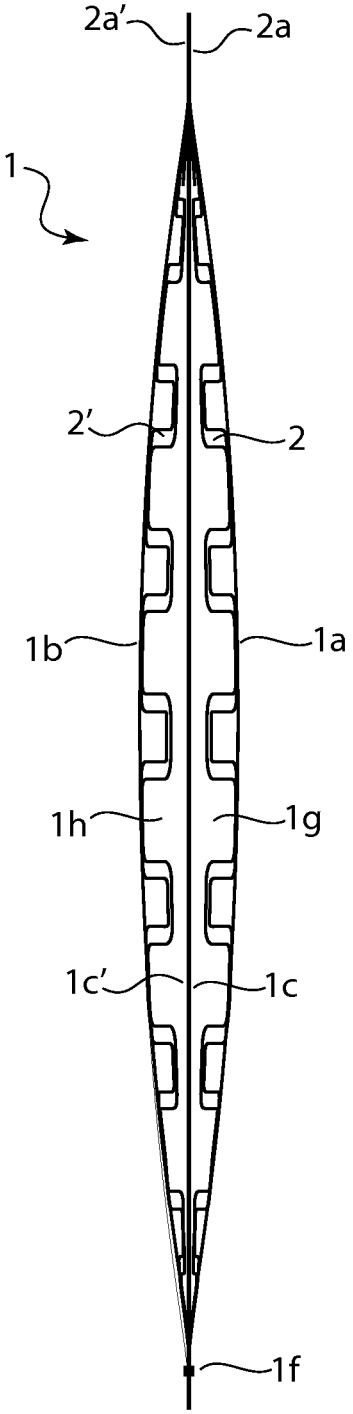
FIG. 2 is a side elevation view of the pouch of FIG. 1, with packette sealed inside.
Figure 3:
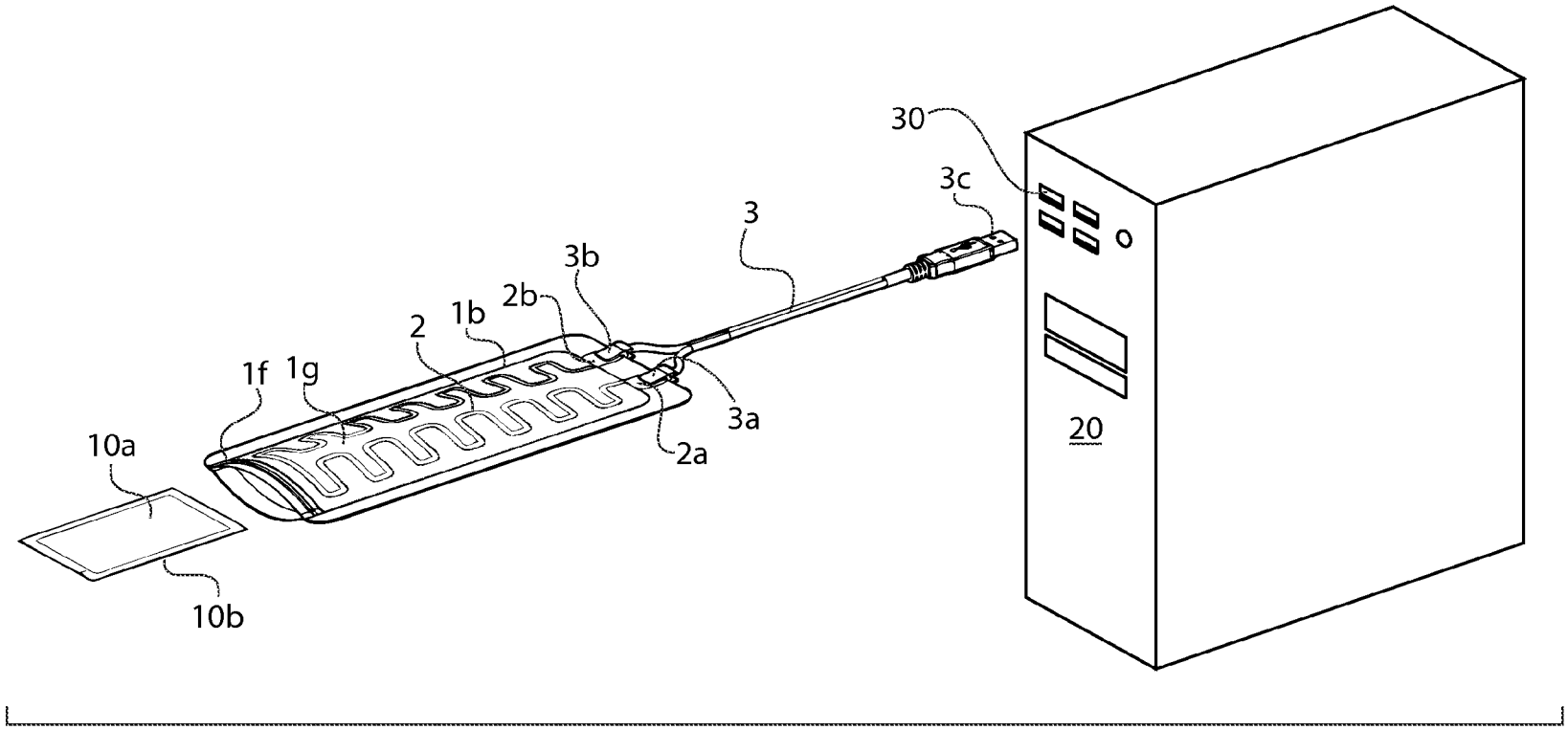
FIG. 3 is a perspective view of a first embodiment of a packette heating system wherein a USB type connector is attached to a pouch which is ready to receive a single-use packette that is to be heated.

Referring to FIGS. 1-3, a pouch (1) according to one embodiment of the present invention comprises top and bottom panels (1*a*, 1*b*). Each panel has a respective first perimeter portion (1*c*, 1*c*'), and respective second perimeter portions (1*d*, 1*d*'). The first perimeter portions are permanently bonded together, thus forming a reservoir (1*e*) located between the two panels. Bonding may be achieved by a continuous line of adhesive or welding, such as sonic welding, for example. The second perimeter portions are not permanently bonded together, thus forming an opening that leads into the reservoir (1*e*). Preferably, the pouch opening is resealable, meaning that the pouch opening is able to be sealed and unsealed repeatedly. In some preferred embodiments the opening is provided with a slider seal (1*f*), of the type commonly known as Ziploc®. Alternatively, zippers, snap fitments, buttons, etc. may be used. The seal need not be airtight if the packette is able to heat up in a reasonable amount of time even when some heat escapes from the reservoir.

The reservoir (1*e*) of the pouch (1) is able to receive one or more cosmetic and/or personal care packettes (10). A typical packette comprises top and bottom panels (10*a*, and 10*b*). Heating of the product in the packette will be more even and efficient when the entire surface of the top and bottom panels of the packette lay flat against the top and bottom panels (1*a*, 1*b*) of the pouch (1). This will give the most area of contact between the pouch and packette, and most transfer of heat to the packette. Therefore, it is preferable if the size of the reservoir (1*e*) and the size of the pouch opening (1*d*) are able to accommodate any packettes (10) that are put into it without having to bend or fold the packette. For example, the reservoir may be generally rectangular (possibly square), and measure 25 mm-150 mm by 25 mm-150 mm. The opening (1*d*) into the reservoir may be as wide as the reservoir or slightly smaller, so the opening is generally 25 mm-150 mm wide.

One or more heating elements (2) are in physical contact with at least one of the panels (1*a*, 1*b*) of the pouch (1). As heat is generated in the heating elements, some of the heat makes its way to the packette (10) in the reservoir (1*e*), thereby raising the temperature of the packette. Heat passes through the packette and into the product inside the packette. The panels of the pouch (1) are designed to facilitate the heating of the packette in the reservoir. We consider two possible constructions. In the first, one or more heating elements (2) are located on one or both exterior surfaces (1*g*, 1*h*) of the pouch panels (1*a*, 1*b*). In this case, heat from the heating element(s) must pass through the panel(s) of the pouch (1) to reach the packette. Therefore, the panel materials, or a significant portion thereof, should conduct heat efficiently.

In the second construction, one or more heating elements are located on one or both interior surfaces (not labeled) of the pouch panels (1*a*, 1*b*). In this case, heat from the heating element does not have to pass through the panel(s) to reach the packette. In this case, it would be more efficient if the panel materials, or a significant portion thereof, are good insulators of heat. This will make heating the packette more efficient.

Heat transfer through the panels (1*a*, 1*b*) of the pouch (1) is a function of the thickness of the panels. In general, if the heating elements reside on an exterior surface of the panels, the actual thickness should be chosen based on the rate of heat transfer and the desired length of time to heat the packette (10). If the heating elements reside on an interior surface of the panels, then the panel thickness may be less restricted, and chosen to keep the heat inside the pouch. In either case, the panel materials should also withstand repeated heating and cooling cycles so that the pouch may be used repeatedly. The panel construction may comprise one material, or a stack, or laminate of different materials. Many of the same plastic films, papers and metal foils that are used in the field of packettes may be useful for the panels of the pouch. Some useful examples of pouch materials include films of polyethylene (PE; low, medium and high density); polyethylene terephthalate (PET); polypropylene (PP); ethylene vinyl acetate (EVA); polybutylene (PB); vinyls; polyesters; styrene polymers; nylon; polycarbonate; acrylics; acrylonitriles; fluoropolymers; cellophane; and aluminum foil. Laminates of these may also be used. For example, a pouch comprising an external layer of PET and an internal layer of low density polyethylene (LDPE), is useful for the invention. Laminates that include aluminum foil to increase heat transfer to the packette inside the bag are also useful. One example of this is PET12/Alu09/PET12/PE75. Most panel constructions are opaque, but one example of a transparent laminate that could be used for the panels is PET12/PET12 coated with silicon oxide/PE75. In this case, the packette inside the pouch would be visible from the exterior. The thicknesses of the panels of the pouch may be on the same order as for packette manufacture say about 100μ to 250μ; preferably 100μ to 200μ; more preferably 100μ to 150μ.

Packette laminates are usually chosen for their enhanced barrier properties, such as low gas permeability and moisture protection. However, those properties will generally be of little or no of concern for the pouch (1). The length of time that a packette spends inside the pouch is short, and the pouch may not have to provide such protections. Rather, the panel materials should be chosen based on one or more of: their ability to help or hinder heat transfer; their ability to accept inks used in printed circuits; and their ability to accept inks or decorative elements used for marketing purposes.

Heating a packette inside the pouch is unlike heating a larger quantity of product in a reservoir (for example heating a mascara product in a saleable size container). In that situation, the volatile components of the product are lost more quickly each time the product in the reservoir is heated and exposed to the ambient atmosphere. Product dry-out is a serious problem to the marketing of such products. However, in the present invention, when used as directed, product dry-out is not a realistic problem, because the packette is heated only once, and the heating time is, in general, too short to adversely affect the product, which is in a sealed package during heating. Thus, even when the product comprises volatile ingredients, there is not sufficient time for the product to be significantly deteriorated by heating, even after the packette is opened.

As mentioned, one or more heating elements may be located on or both of the panels (1*a*, 1*b*) of the pouch (1), on the exterior of the pouch. In one embodiment, a heating element (2) is formed as a continuous electric path that has a positive terminal (2*a*) and a negative terminal (2*b*) located on or near the first perimeter portion (1*c*) of that panel on which the heating element is located. The resistive electric path loops over the panel of the pouch to generate heat evenly over the panel. An external power source may be connected to the resistive path of the pouch through power leads, thus completing a heating circuit. Preferably, the connection can be established and removed at will. For example, the connection may be achieved with metal clamps (3*a*, 3*b*), such as alligator clips or other spring-loaded clips. Electricity from a source external to the pouch arrives at one terminal, passes through the circuit where electrical resistance generates heat, and leaves at the other terminal. If there is a second heating element (2') on the other side of the pouch (see FIG. 2), then that element may terminate at the same positive and negative terminals (2*a*, 2*b*) by wrapping around the edge of the pouch. Alternatively, a second set of positive and negative terminals (2*a*', 2*b*') may be provided at the ends of the second heating element, preferably opposite the first set of terminals (2*a*, 2*b*). This way, connecting the heating element on one side of the pouch automatically connects the heating element on the other side of the pouch. Otherwise, separate connections must be provided.

Connection to Power Source

The heating pouch requires an electrical connection to a power source. The connection must be such that it can be established and removed at will (hereinafter, a "removable" connection to power). The present invention includes electric power leads that are designed to cooperate with the heating pouch. One embodiment is shown in FIG. 3 where power cable (3) comprises metal clamps, such as spring loaded clips (3*a*, 3*b*), at one end, and a USB-type connector (3*c*) at the other end. In this embodiment, the heating pouch may be powered by connecting the USB-type connector to a charging device having a complementary USB jack (30), such as a computer (20), automobile console, courtesy outlet in a bus or plane, or other device that can provide low voltage electric power. Once contact is established between the spring loaded clips (3*a*, 3*b*) and the positive and negative terminals (2*a*, 2*b*) of the pouch heating element, a heating circuit is completed (i.e. closed) and electricity will flow from the charging device, through the heating elements of the pouch and back to the charging device. While this is happening, heat is generated, and the interior of the pouch is heated. When the clips are removed, then the circuit is opened, and heating stops.

Figure 4:
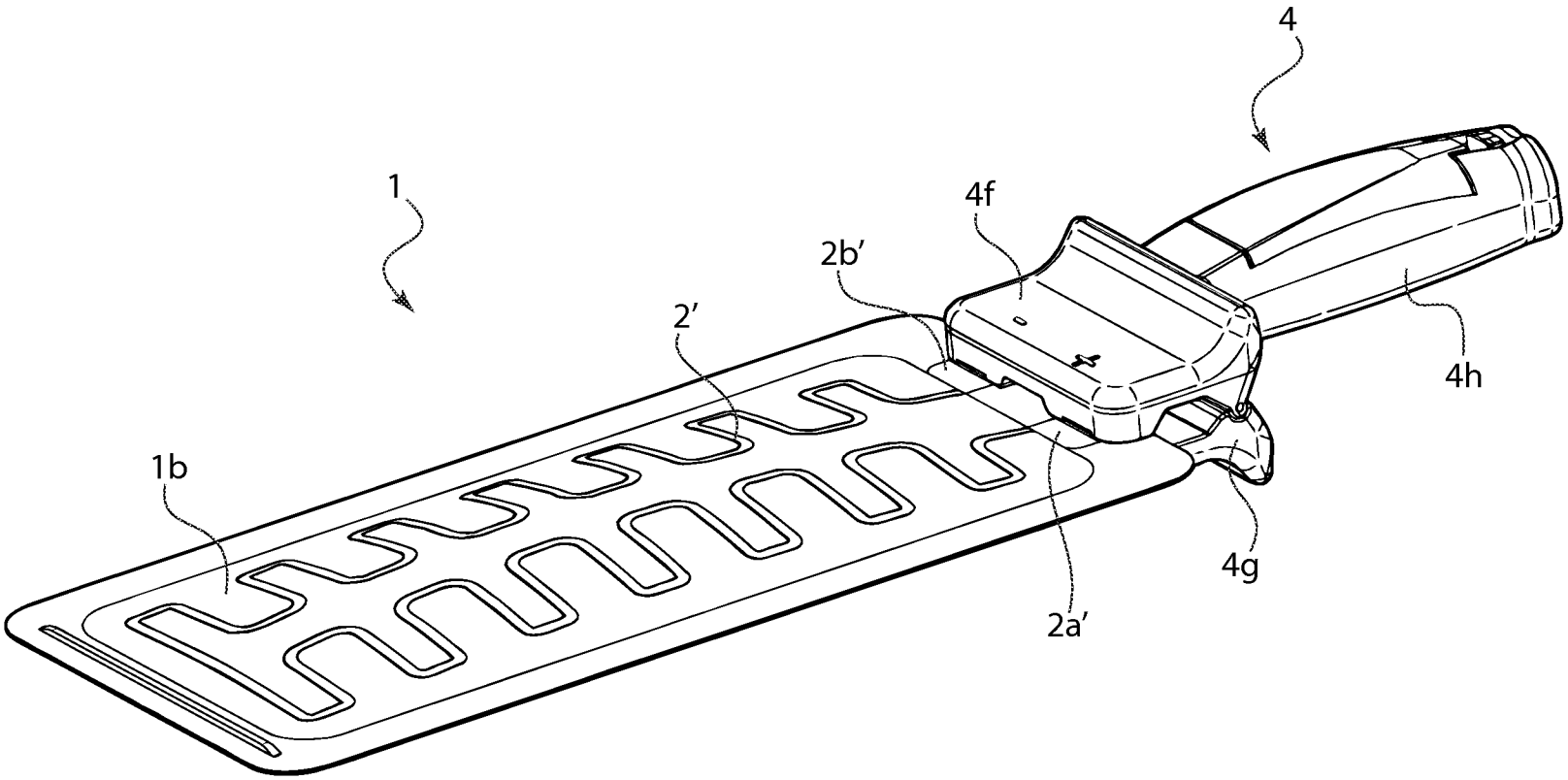
FIG. 4 is a perspective view a second embodiment of a packette heating system wherein power tongs are clipped on to a pouch having a packette sealed inside.
Figure 5:
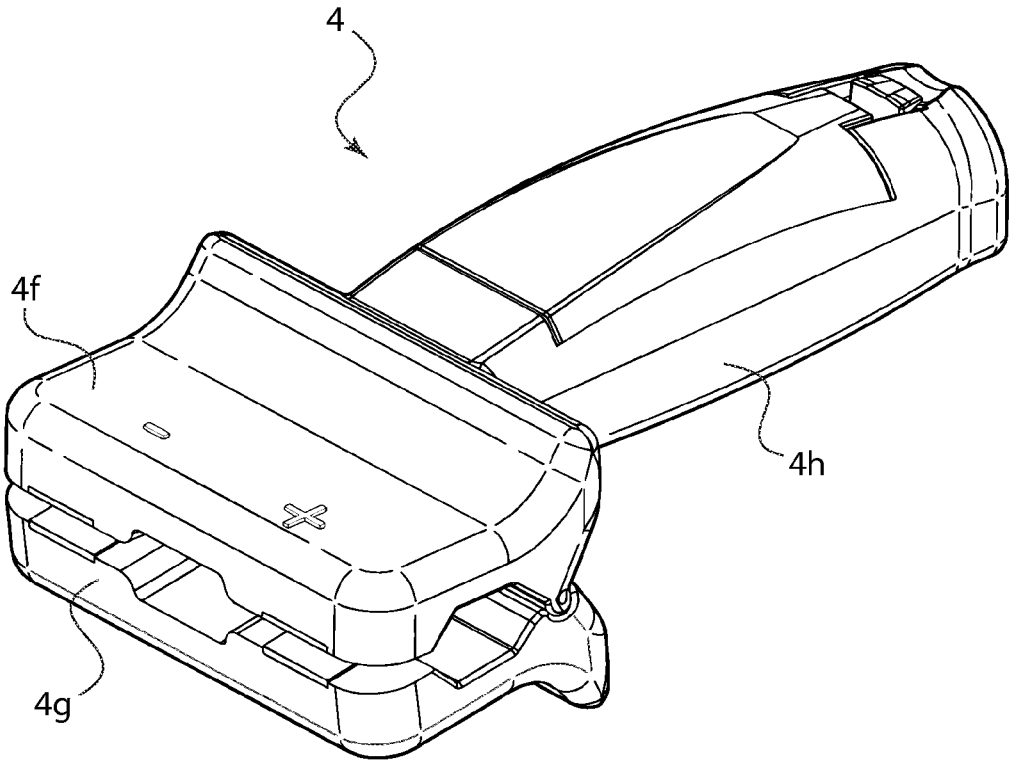
FIG. 5 shows one embodiment of a set of clip on power tongs for use with a heating pouch of the present invention. The jaws of the tongs are shown in a opened position.
Figure 6:
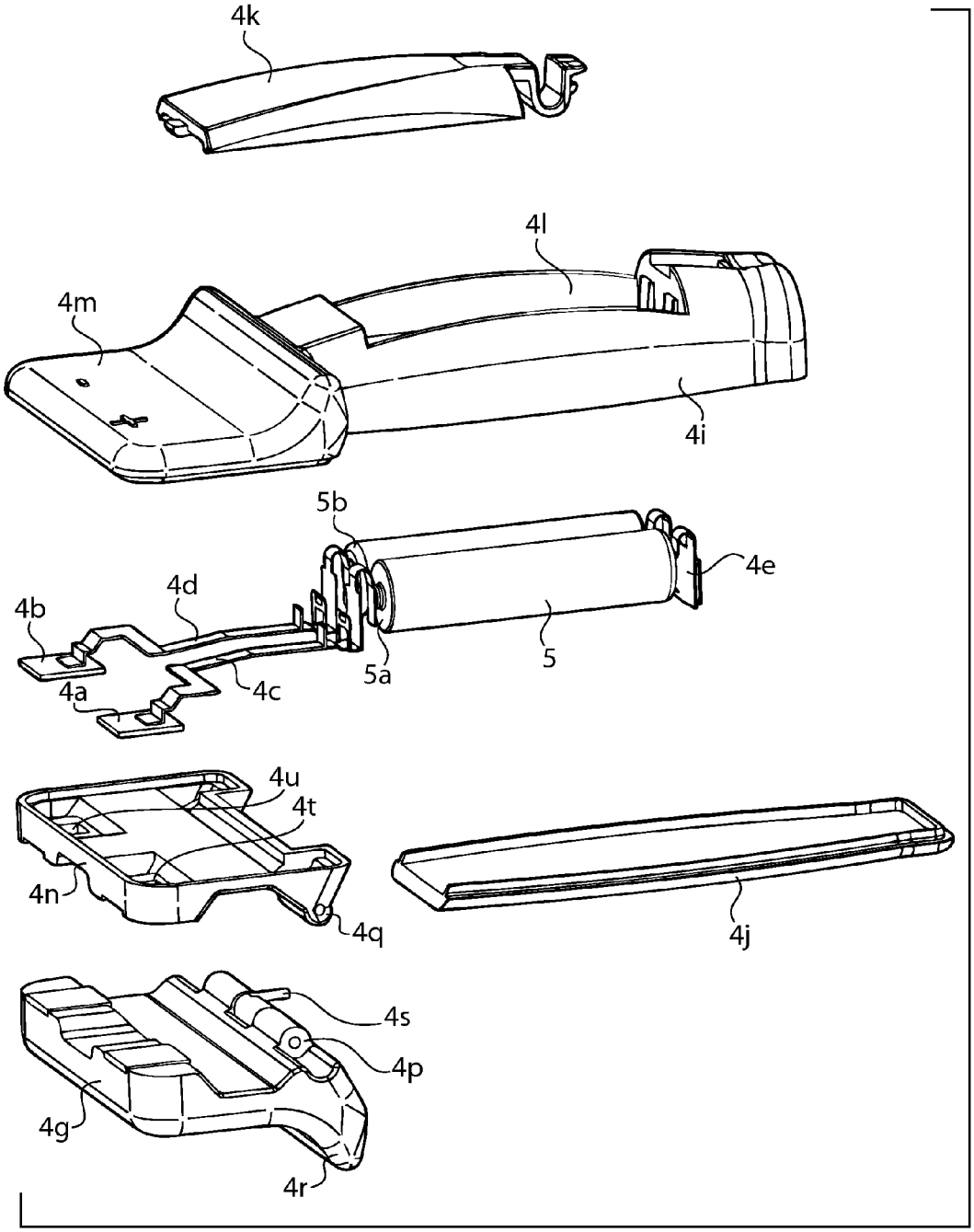
FIG. 6 is an exploded view of the power tongs of FIG. 5.
Figure 7:
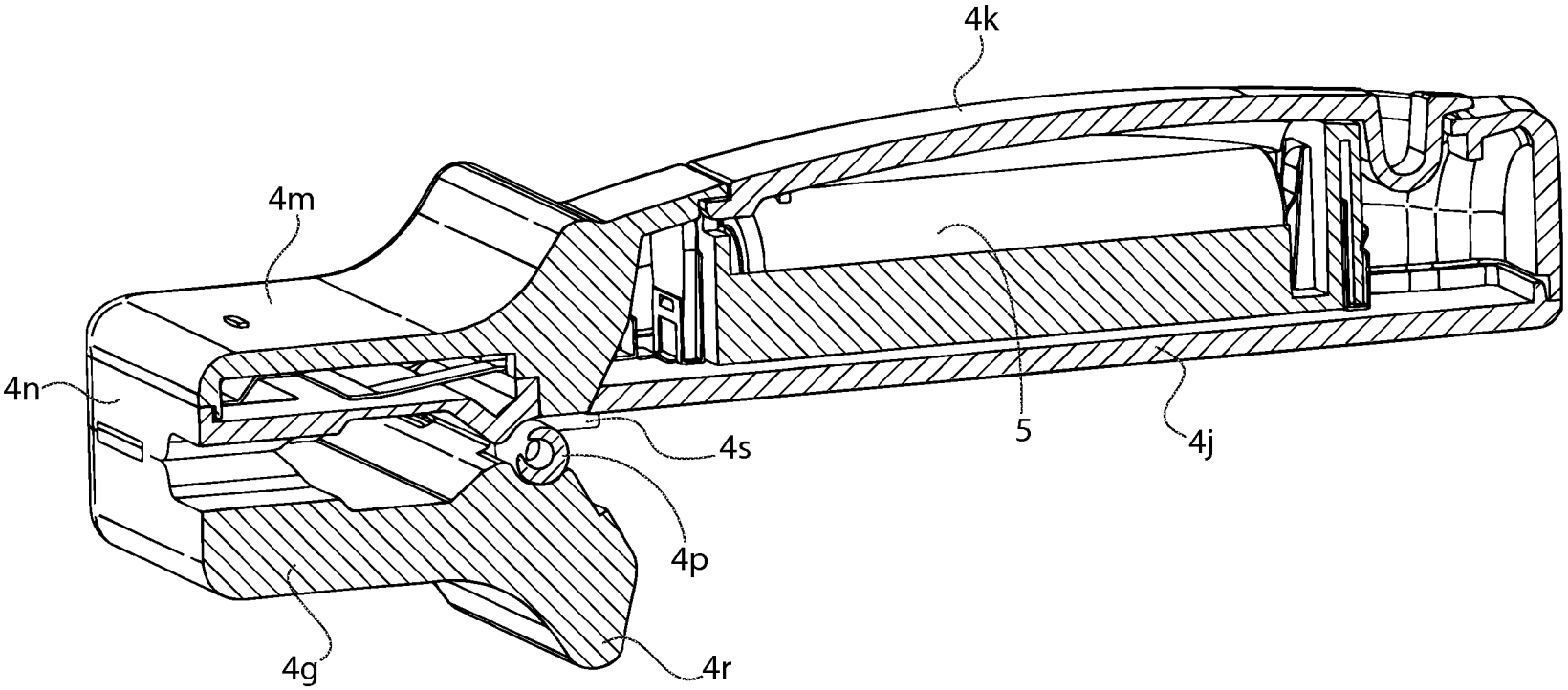
FIG. 7 is a cross sectional view of the power tongs of FIG. 5, except the jaws of the tongs are shown in an closed position.

FIG. 4 shows another embodiment of the electrical power leads that are designed to cooperate with the heating pouch (1). Power tongs (4) are designed to clip onto the edge of the pouch (1) and make electrical contact with the positive and negative terminals (2*a*', 2*b*', and possibly 2*a*, 2*b*) of the pouch. The power tongs comprise a handle (4*h*), a stationary jaw (4*f*) and a spring loaded movable jaw (4*g*). The tongs are shown in more detail in FIGS. 5-7, and these will now be described.

The handle (4*h*) comprises a main body (4*i*), a base (4*j*), and a cover (4*k*). The main body, base and cover define a battery compartment (4*l*) that is suitable to house one, two or more batteries in electrical series. The cover is preferably removable by a consumer, so that the batteries (5) may be replaced. The stationary jaw (4*f*) comprises an upper stationary jaw (4*m*) and a lower stationary jaw (4*n*). The lower stationary jaw has two holes (4*t*, 4*u*) through which protrude the power terminals (4*a*, 4*b*). The power terminals are positioned such that they are able to simultaneously make contact with the positive and negative terminals (2*a*', 2*b*') of the heating element (2') of the pouch (1). By "stationary jaw" we mean that the jaw is stationary with respect to the main body (4*i*) of the handle (4*h*).

The main body (4*i*), the base (4*j*). and the upper stationary jaw (4*m*) may be assembled after being individually manufactured, or they may be of unitary construction. The lower stationary jaw (4*n*) is connected to the upper stationary jaw after the power leads (4*c*, 4*d*) have been assembled, as shown. All parts may be assembled by any suitable means, such snap fitments, adhesive or welding. Once assembled, the upper and lower stationary jaws form one composite jaw element, in which pass the power leads (4*c*, 4*d*) that are able to ferry electricity to and from the one or more batteries (5), and to and from the power terminals (4*a*, 4*b*). The one or more batteries are provided in the battery compartment (4*l*). When there is more than one battery, these are electrically connected in series via one or more jumpers (4*e*). The cathode (5*a*) and the anode (5*b*) of the battery (or of the batteries in series) have electrical contact with power leads (4*c*, 4*d*).

The movable jaw (4*g*) comprises a hinge (4*p*) that cooperates with hinge (4*q*) of the lower stationary jaw (4*n*). In the embodiment shown, a pin-type hinge is provided to connect the two parts in a movable articulation. A spring element (4*s*) is provided that biases the movable jaw against the lower stationary jaw, so that the edge of the heating pouch (1) may be held firmly between the jaws. When this is done, then the power terminals (4*a*, 4*b*), which protrude through the holes (4*t*, 4*u*) of the a lower stationary jaw (4*n*), have physical contact with the positive and negative terminals (2*a*', 2*b*') of the pouch heating element (2').

Once contact is established between the power terminals (4*a*, 4*b*) and the positive and negative terminals (2*a*', 2*b*') of the pouch heating element, a heating circuit is completed (i.e. closed) and electricity will flow from the batteries through the heating elements of the pouch and back to the batteries. While this is happening, heat is generated and the interior of the pouch is heated. When the jaws of the tongs are opened, and contact between the power terminals and heating element terminals is broken, the circuit is opened, and heating stops. The jaws of the tongs may be opened by applying finger pressure to the extension (4*r*) in the direction of the handle (4).

The power tongs are a relatively small, and of lightweight plastic and metal construction. The tongs are a handheld and portable device that is easy to use, thus making it possible to use the heating pouch anywhere, even when mains power and a USB power connection are not available.

The Heating Element(s)

A heating element (2) of the present invention comprise one or more Flexible Printed Circuits. Flexible Printed Circuits (FPCs) are well known by persons skilled in the art. A basic FPC comprises a dielectric substrate as a base, an adhesive layer on top of the substrate, conductor elements arranged on the adhesive, and a protective layer over the circuit elements. Typical substrate materials include polyimide, polyester, polyethylene, fluorocarbon films, aromatic polyamide papers, composites and many others. The substrate may be curved and/or flexible.

Typical conductor materials include metal foils, such as copper and aluminum, and metal mixtures including stainless steel, beryllium-copper, phosphor-bronze, copper-nickel and nickel-chromium resistance alloys. However, one of the most cost effective methods of depositing conductor material onto a flexible substrate uses conventional ink printing techniques. Polymer thick film (PTF) inks may be applied to a substrate using various technologies known from conventional ink printing, such as screen printing, flexography, gravure, offset lithography, and inkjet printing. Printed PTF electronics is a comparatively low cost, high volume process. PTF inks are a mixture of a polymer binder (i.e. polyester, epoxy, acrylic) and a granulated conductive material such as silver, resistive carbon or both. The ink may be applied directly to the substrate without a separate adhesive. Although silver and carbon polymer thick-film (PTF) inks are the most common inorganic inks, various companies offer an assortment of other ink types, such silver chloride, silver carbon, platinum, gold, and phosphors. Organic ink types include conductive polymers such as poly(aniline) and poly(3,4-ethylene dioxitiophene), doped with poly(styrene sulfonate). Polymer semiconductors include poly(thiopene)s like poly(3-hexylthiophene) and poly(9,9-dioctylfluorene co-bithiophen). Those inks that when cured offer greater flexibility and scuff resistance are generally preferred.

Of particular note for the present invention are positive thermal coefficient (PTC) inks, such as PTC-614, PTC-842, PTC-921 and PTC-922 inks available from Conductive Compounds (Hudson, N.H.). These inks are suitable for low DC voltage applications, and are self-regulating, which means that once a certain temperature is reached, the ink is able to maintain a temperature range (for example, 45° C. to 50° C. or 50° C. to 60° C. or 60° C. to 70° C.) without a feedback loop.

One or more FPCs may be incorporated into the invention by adhering one or more prefabricated FPCs to one or more surfaces of the heating pouch (1) using an adhesive. Examples of prefabricated FPCs include those manufactured by Minco (Minneapolis, Minn.) and those manufactured by Tempco (Wood Dale, Ill.). Alternatively, one or more FPCs may be printed directly onto one or more interior or exterior surfaces of the pouch. In either case, when the FPC is to be applied to an exterior surface of the pouch, then the FPC may be applied to the pouch either before or after the top and bottom panels (1*a*, 1*b*) of the pouch are bonded together. If the FPC is to be applied to the interior surface of the pouch, then the FPC should be deposited before the panels of the pouch are bonded.

In general, the substrate of a Flexible Printed Circuit may incorporate bulkier non-printed electronic elements. Technically speaking, there is nothing that prevents the incorporation of such elements in the printed circuit of the pouch (1); it's a question of cost and convenience. Electronic elements that may be useful include thermistors, timers, voltage regulators, capacitors, resistors, LEDs, integrated circuit chips, logic gates, etc.

In preferred embodiments of the tongs (4), power is supplied by one or more batteries. Many types of battery may be used, as long as the battery can deliver the requisite power to achieve defined performance levels. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches. Furthermore, it is preferable if the battery is disposable in the ordinary household waste stream. Therefore, batteries which, by law, must be separated from the normal household waste stream for disposal (such as batteries containing mercury) are less preferred. As noted, the handle (4*h*) comprises a cover (4*k*) that provides access to the battery compartment (4*l*), so that the batteries are replaceable. Optionally, the batteries are rechargeable. To that end, either the batteries can be removed from the handle, as just described, or the exterior of the system can be provided with electric leads to the batteries, such that the system can be reposed in a charging base, so that power from the base is transmitted to and stored in the batteries.

For increased heating efficiency, the printed heating element (2) should cover an appreciable portion of the surface of the pouch panels (1*a*, 1*b*). For example, as shown in FIG. 1, the heating element extends from one end of the pouch (1) to the other, and from one side of the pouch to the other.

In preferred embodiments, the time to heat a pouch (1) to at least 50° C. is 3 minutes or less; more preferred is 2 minutes or less. Experience has shown that when energy is converted at a rate of 5 W to 10 W, then the temperature of typical sample size packettes can be raised by at least 25° C. in the requisite time. Some USB specifications fix the voltage at 5 V±5% (4.75 V to 5.25 V). A common battery has a nominal voltage of 1.5 V or 3.0 V. If up to four of them are used, then a voltage of about 12 V is available. A pouch of the present invention utilizes low voltage typically in the range of 1.5 V to 12 V. By adjusting the resistance of the heating element, the desired power conversion rate may be achieved. The electrical resistance of the heating element can be adjusted by the composition of the ink, by the amount of ink deposited, and by the cross sectional area of the deposited ink. A useful range of heating element resistance is about 1Ω to about 15Ω; preferred is 2Ω to 10Ω; more preferred is 3Ω to 5Ω. For example, if the heating element resistance is between about 2.5Ω and 5Ω, then a 5 V power supply produces a current of about 1 A to 2 A, and power is provided at about 5 W to 10 W. In one working embodiment of the pouch (1), these parameters resulted in the pouch being heated to 50° C. in 2-3 minutes. The self-regulating nature of the positive thermal coefficient ink used in this circuit prevented the temperature from increasing beyond about 50° C., even if the circuit is left on for an extended period of time.

Methods of Use

In use, a person having a packette (10) and a heating pouch (1), as described herein, inserts the packette into the reservoir (1*e*) through the opening (1*d*) in the perimeter of the pouch. The pouch is closed or sealed by the means provided, as discussed above. The pouch is placed in the grip of a power tongs (4), such that electrical contact is established between the positive and negative terminals (2*a*', 2*b*') of the heating element (2') and the power terminals (4*a*, 4*b*) of the tongs. The pouch and tongs are allowed to remain connected for a time sufficient to heat the product in the packette to a product application temperature. Thereafter, the pouch is removed from the grip of the tongs. The heating pouch is opened, and the heated packette is removed from the pouch. The packette is opened, and the heated product is dispensed and applied to a person's skin, hair or nails.

Alternatively, a person having a packette (10) and a heating pouch (1), inserts the packette into the reservoir (1*e*) through the opening (1*d*) in the perimeter of the pouch. The pouch is closed or sealed by the means provided, as discussed above. The two metal clamps or clips (3*a*, 3*b*) of the USB power cable (3) are attached to the positive and negative terminals (2*a*, 2*b*) of the heating element (2), as shown in the figures. The USB-type connector (3*c*) of the USB cable is inserted into a USB jack on a computer, automobile console, courtesy outlet on a bus or plane, or other device that can provide electric power, such that electricity flows through the heating element. Electricity is allowed to flow through the heating element for a time sufficient to heat the product in the packette to a product application temperature. Thereafter, the flow of electricity is stopped by removing the clips of the USB cable from the pouch and/or removing the USB-type connector from the USB jack. The heating pouch is opened, and the heated packette is removed from the pouch. The packette is opened, and the heated product is dispensed and applied to a person's skin, hair or nails.

Some Optional Features

In some preferred embodiments, a shut off timer is included to preserve the batteries, in case a user accidentally leaves the circuit closed beyond the time needed to heat the product in the packette. Optionally, an indicator that tells the user when the application temperature is reached is included in the heating circuit. The indication may be incorporated into the pouch (1) or into the power tongs (4). The indicator may be a light (such as an LED) that turns on or off when the product reaches a desired temperature or after a predetermined time. Another indicator may be a thermo-chromic material incorporated into the pouch, that turns a certain color when a set temperature has been reached.

In some embodiments, the USB cable (3) as described herein is preferred. By connecting the USB cable to a device with internet or other network access, it may be possible to transfer data to and from the pouch, as well as power. For example, the pouch may be configured with an integrated circuit having programmed instructions. When the heating circuit is completed by plugging the USB plug into an internet enabled device, the coded instructions of the pouch may pass to the device, to initiate all sorts of informational and media experiences normally associated with such devices. For example, when the USB plug is inserted into an internet enabled device, a web site may be launched having content that complements the use of the product. For example, a video of a beauty advisor who offers advice and information about the use of one or more products may appear, or a promotional offer for a saleable size package of the product may be made. The experience can be interactive, so the user can identify which product she is sampling and the appropriate content can be downloaded the users device. The device must be able to provide sufficient power to heat the packette, and still run the device. As consumer electronics continue to improve, the number of electronic devices that are able supply the requisite power will only increase. In the process, the use of a conventional packette has been transformed into a multi-sensory experience.

The power tongs (4) will be preferred anytime that USB power is not conveniently available. For example, when travelling or at an in-store cosmetics counter, the power tongs may be preferred. A counter salesperson can heat sample after sample for curious consumers without the need to plug the heating pouch (1) into a computer. Likewise, access to USB power may not be convenient when travelling, but the battery powered tongs (4) are handheld and convenient.

What we claim is:

1. A packette heating system comprising:

a heating pouch that comprises:

top and bottom panels having:

respective first perimeter portions that are permanently bonded together to form a reservoir between the two panels, the reservoir measuring 25 mm-150 mm by 25 mm-150 mm;

respective second perimeter portions that form a pouch opening that leads into the reservoir; and one or more heating elements that are in physical contact with at least one of the panels, wherein each heating element:

is a continuous resistive electric path that has a positive terminal and a negative terminal located near the first perimeter portion of that panel on which the heating element is located;

has a resistance between 1Ω and 15Ω, and is able to convert electrical energy into heat at a rate of 5 watts to 10 watts; and comprises a positive thermal coefficient ink that is printed onto the exterior surface of the top or bottom panel; and a power cable having two metal clamps at one end, and a USB-type connector at the other end for connecting an external power source to the positive and negative terminals of the heating packette, wherein the voltage of the power source is in the range of 1.5 V to 12 V;

wherein the pouch is configured with an integrated circuit having programmed instructions, and the USB-type power cable is able to transfer data to and from the pouch.

2. The heating pouch of claim 1 wherein the top and bottom panels are 25μ to 100μ thick.

3. The heating pouch of claim 1 wherein the pouch opening is resealable.

4. The packette heating system of claim 1 wherein the external power source comprises one or more batteries.

5. A method of using a packette heating system of claim 1 comprising the steps of:

inserting a packette into the reservoir of the pouch;

attaching the metal clamps of the power cable to the positive and negative terminals of the heating element;

inserting the USB-type connector into a USB jack that can provide electric power such that electricity flows through the heating element;

allowing electricity to flow through the heating element for a time sufficient to heat the product in the packette to a product application temperature;

stopping the flow of electricity; and removing the packette from the heating pouch.

* * * * *